United States Patent [19]

Hill

[11] 4,124,959

[45] Nov. 14, 1978

[54] CLOTHES DRIER SOCKET

[75] Inventor: Barry C. Hill, Seaview Downs, Australia

[73] Assignee: Hills Industries Limited, Edwardstown, Australia

[21] Appl. No.: 823,676

[22] Filed: Aug. 11, 1977

[30] Foreign Application Priority Data

Aug. 16, 1976 [AU] Australia ..... PC7004

[51] Int. Cl.[2] ..... E02D 27/42

[52] U.S. Cl. ..... 52/298; 52/297; 52/40; 52/706; 52/709; 403/348

[58] Field of Search ..... 52/40, 296, 297, 298, 52/165, 166, 704, 706, 709, 707, 711, 731; 248/533, 156, 222.3, 73; 403/348, 349; 211/119.01

[56] References Cited

U.S. PATENT DOCUMENTS

| | | | |
|---|---|---|---|
| 1,946,694 | 2/1934 | Hunter | 52/731 X |
| 2,283,987 | 5/1942 | Hammar | 52/298 X |
| 3,042,161 | 7/1962 | Meyer, Jr. | 52/704 |
| 3,124,385 | 3/1964 | Neptune | 52/704 X |
| 3,391,515 | 7/1968 | Clay | 52/709 |
| 3,420,032 | 1/1969 | Felt | 52/731 |
| 3,885,648 | 2/1975 | Beziat | 403/349 X |
| 4,079,983 | 3/1978 | Mastrigt | 52/709 X |

FOREIGN PATENT DOCUMENTS

| | | | |
|---|---|---|---|
| 443,980 | 3/1936 | United Kingdom | 52/298 |

*Primary Examiner*—Ernest R. Purser
*Assistant Examiner*—Carl D. Friedman
*Attorney, Agent, or Firm*—Jay L. Chaskin

[57] ABSTRACT

A socket comprises a pair of L shaped sheet metal members which interlock to form a square tube, the walls having surfaces which define at least one pair of bayonet slots, each having an entry limb and a retaining limb. The clothes drier standard has a bayonet pin extending outwardly in a transverse direction, and this can be accommodated diagonally in the square tube during insertion, and subsequently rotated to have its ends register with the entry limbs and be guided by the entry limbs into the retaining limbs of the two slots.

6 Claims, 3 Drawing Figures

CLOTHES DRIER SOCKET

This invention relates to a clothes drier socket which can be embedded in concrete for supporting a clothes drier the standard of which can be lowered into the socket or taken away from the socket.

BACKGROUND OF THE INVENTION

Certain clothes driers are of light weight, but these are usually employed in situations where there is limited space and quite frequently there is a need for a clothes drier to be temporarily withdrawn from its socket and stowed at some convenient location.

Various clothes drier sockets have been devised heretofore, but there are a number of difficulties which are encountered. Firstly, the cost of a tubular socket is relatively high, and in any case such a socket requires means for retaining the stem of a clothes drier to prevent accidental withdrawal. One object of this invention is to provide a socket which has a relatively low cost. Secondly, previous sockets have frequently failed to prevent incorrect insertion, and another object of this invention is to provide a socket which will be unlikely to accept a standard if incorrectly inserted. It is a still further object to provide a socket which will pack down into a relatively small space for packaging purposes.

However, the main object of the invention is to provide a socket into which a clothes drier standard can be quickly and easily moved into a retaining position after insertion, and is unlikely to be accidentally displaced from that retaining position.

BRIEF SUMMARY OF THE INVENTION

In one embodiment of the invention, a socket comprises a pair of L shaped sheet metal members which interlock to form a square tube, the walls having surfaces which define at least one pair of bayonet slots, each having an entry limb and a retaining limb. The clothes drier standard has a bayonet pin extending outwardly in a transverse direction, and this can be accommodated diagonally in the square tube during insertion, and subsequently rotated to have its ends register with the entry limbs and be guided by the entry limbs into the retaining limbs of the two slots.

More specifically, in one aspect the invention consists of a clothes drier socket which is co-operable with a clothes drier standard having a bayonet pin extending outwardly therefrom in a transverse direction, the socket having a noncircular cross-sectional shape, its side walls including surfaces which define at least one pair of bayonet slots to receive the ends of said bayonet pin, each slot having an entry limb which extends transversely and a retaining limb which extends longitudinally, the arrangement being such that the standard is insertable into the socket with the bayonet pin out of alignment of the bayonet slots, but upon rotation after insertion the ends of the pin move into register with the entry limbs of the slots and are guided by the defining surfaces thereof into the retaining limbs.

BRIEF DESCRIPTION OF THE DRAWINGS

An embodiment of the invention is described hereunder in some detail with reference to and is illustrated in the accompanying drawings, in which.

Figure 1:
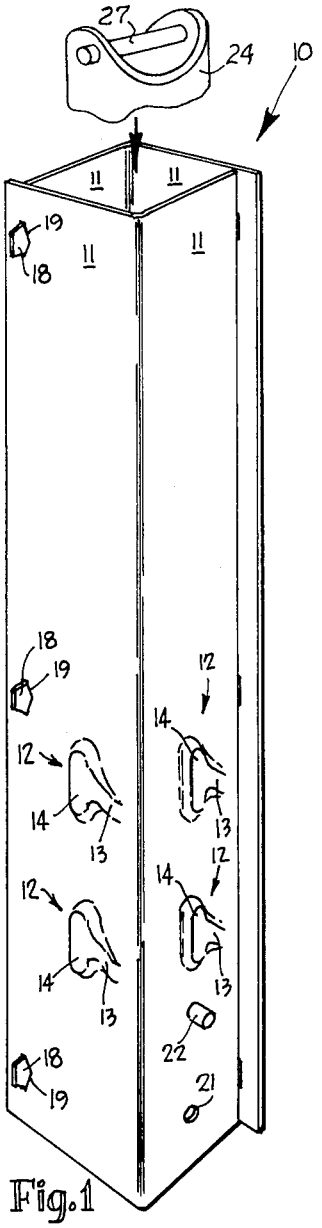
FIG. 1 is a perspective view of the socket.
Figure 2:
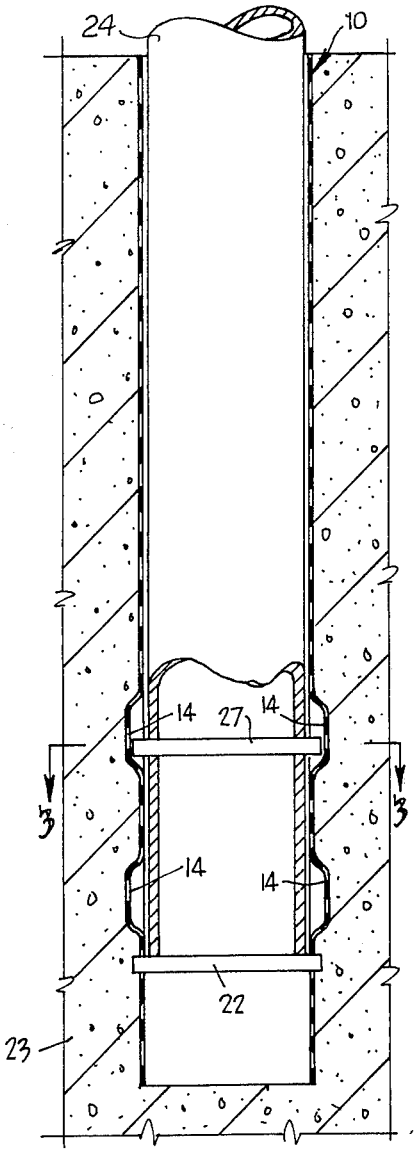
FIG. 2 is a central longitudinal section of same, showing a bayonet pin of a clothes drier standard in engagement with a pair of opposite bayonet slots.
Figure 3:
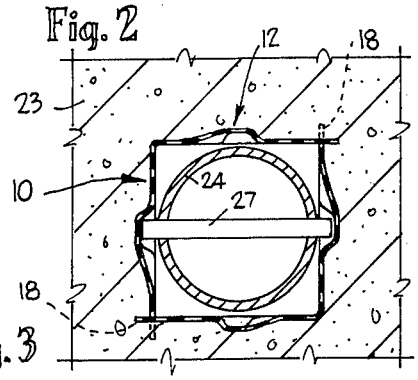
FIG. 3 is a crosssection taken on line 3—3 of FIG. 2.

In this embodiment a clothes drier socket 10 is formed from two pressings each of which is identical to the other. Each pressing has two flanges 11 which form an L-shaped cross-section, is of sheet metal, and is formed to have four bayonet type sockets 12. Each socket 12 has two limbs, one limb designated 13 being an entry limb which extends in a transverse direction (in some instances from the folded corner between the flanges 11, in the other instances from the flange edge) towards the centre, but slopes upwardly; the other limb designated 14 being a retaining limb, and extending longitudinally with respect to the socket (that is, vertically). The limb 14 extends both above and below the entry limb 13 so that accidental release of the bayonet lock is unlikely to take place. Each limb is formed in the metal by pressing the metal of the flanges to have depressions the side walls of which guide the ends of the bayonet pin (described below).

Each shorter flange 11 of the sheet metal pressing has outwardly projecting tongues 18 and each longer flange extends beyond slots 19 therein which are engaged by the tongues so as to provide means to retain the two pressings in a square tube assembly until they are embedded in concrete. Each flange 11 contains two vertically spaced apertures 21 (spaced apart by the same vertical spacing which exists between the sockets 12), and one pair of aligned apertures 21 contains a support pin 22 which extends across the socket and projects from flanges 11, to be contained in concrete 23 in which the socket 10 is embedded (and by which its shape is retained). The existence of two spaced apertures, and vertically spaced sockets, provides height adjustment means for the clothes drier standard 24 and thereby for the clothes drier when installation takes place, one set of bayonet sockets 12 only being employed.

The standard 24 is provided with a bayonet pin 27 the ends of which project outwardly by a small distance, such that the standard 24 can be inserted in the socket 10 with the pin 27 extending diagonally, and the pin 27 will be correctly located in height to enter the entry limbs of two opposite bayonet sockets 12 when the lower end of the standard is supported on the support pin 22. By rotating the standard 24 and lifting it slightly, the bayonet pin 27 engages the retaining limbs 14 of the bayonet sockets, and is constrained by the socket walls for limited vertical movement, until the pin is again released by partly lifting the standard and rotating in a reverse direction.

Various modifications in the disclosed embodiments may be made by one skilled in the art without departing from the scope of the invention as defined by the claim.

I claim:

1. A clothes drier socket which is co-operable with a clothes drier standard having a bayonet pin extending outwardly therefrom in a transverse direction, the socket comprising two sheet metal members each having two flanges which form an L shape in cross-section, and means interlocking the members so that they form a square tube, said flanges including depressions surfaces of which define at least one pair of bayonet slots to receive the ends of said bayonet pin, each slot having an entry limb which extends transversely and a retaining limb which extends longitudinally, the arrangement being such that the standard is insertable into the socket with the bayonet pin out of alignment of the bayonet slots, but upon rotation after insertion the ends of the pin move into register with the entry limbs of the slots and are guided by the defining surfaces thereof into the retaining limbs.

2. A clothes drier socket according to claim 1 wherein said sheet metal members are of identical shape, and said interlocking means comprise tongues projecting from one side of a said member engaging the walls of complementary slots in a side of the other said member.

3. A clothes drier socket according to claim 1 wherein the entry limb of each said bayonet slot slopes upwardly towards the retaining limb.

4. A clothes drier socket according to claim 3 wherein the entry limb of each said bayonet slot merges into the retaining limb between the upper and lower ends of the retaining limb.

5. A clothes drier socket according to claim 1 further comprising a support pin extending across the square tube and projecting through apertures in the walls thereof.

6. A clothes drier socket according to claim 1 wherein each said L-shaped member has two bayonet slots in each of its flanges.

* * * * *